US010666000B2

(12) United States Patent
Zheng et al.

(10) Patent No.: US 10,666,000 B2
(45) Date of Patent: May 26, 2020

(54) COAXIAL BIAS T-CONNECTOR

(71) Applicant: CommScope Technologies LLC, Hickory, NC (US)

(72) Inventors: Jien Zheng, Jiangsu (CN); Yujun Zhang, Jiangsu (CN); Xianxiang Li, Jiangsu (CN)

(73) Assignee: CommScope Technologies LLC, Hickory, NC (US)

( * ) Notice: Subject to any disclaimer, the term of this patent is extended or adjusted under 35 U.S.C. 154(b) by 0 days.

(21) Appl. No.: 16/273,296

(22) Filed: Feb. 12, 2019

(65) Prior Publication Data

US 2019/0288463 A1 Sep. 19, 2019

(30) Foreign Application Priority Data

Mar. 14, 2018 (CN) ..... 2018 1 0206740

(51) Int. Cl.
*H01R 9/05* (2006.01)
*H01R 13/187* (2006.01)
(Continued)

(52) U.S. Cl.
CPC ..... *H01R 24/42* (2013.01); *H01R 9/05* (2013.01); *H01R 13/187* (2013.01); *H01R 24/50* (2013.01); *H01R 2103/00* (2013.01)

(58) Field of Classification Search
CPC ..... H01R 24/42; H01R 24/50; H01R 9/05; H01R 9/0503; H01R 9/0506;
(Continued)

(56) References Cited

U.S. PATENT DOCUMENTS 3,439,294 A * 4/1969 Flanagan ..... H01R 9/0518 333/33
4,480,887 A * 11/1984 Morelli ..... H01R 13/646 439/275

(Continued)

FOREIGN PATENT DOCUMENTS

EP 1720212 10/2010

OTHER PUBLICATIONS

International Search Report and Written Opinion corresponding to International Application No. PCT/US2019/018692 dated Jun. 5, 2019.

*Primary Examiner* — Oscar C Jimenez
(74) *Attorney, Agent, or Firm* — Myers Bigel, P.A.

(57) ABSTRACT

A coaxial bias T-connector includes: first and second coaxial cables; a rear body electrically connected to the first cable outer conductor; a first inner contact positioned within the rear body and electrically connected with the first inner conductor; a front body connected with the rear body and including a forward portion; a second inner contact positioned within the front body and electrically connected with the first inner contact; a spring basket including a plurality of spring fingers and electrically connected with the forward portion of the front body and electrically isolated from the second inner contact, the forward portion of the front body, the spring fingers and the second inner contact forming a 4.3/10 interface; a third inner contact electrically connected with the second cable inner conductor; and a coaxial fitting electrically connected with the front body and with the second cable outer conductor. The third inner contact is in electrical connection with the second inner contact.

16 Claims, 3 Drawing Sheets

(51) Int. Cl.
*H01R 24/50* (2011.01)
*H01R 103/00* (2006.01)
*H01R 24/42* (2011.01)

(58) Field of Classification Search
CPC .... H01R 9/0509; H01R 9/0515; H01R 13/17; H01R 13/187; H01R 2103/00
See application file for complete search history.

(56) References Cited

U.S. PATENT DOCUMENTS 4,746,305 A * 5/1988 Nomura ..... H01R 13/625 439/319
4,824,399 A * 4/1989 Bogar ..... H01R 24/542 29/747
5,154,635 A * 10/1992 Kaufman ..... H01R 24/52 174/111
5,278,525 A * 1/1994 Palinkas ..... H03H 1/00 333/175
5,371,466 A * 12/1994 Arakawa ..... G01R 33/3685 324/318
6,065,976 A 5/2000 Wang
6,287,144 B1 * 9/2001 Baffert ..... H01R 4/28 439/578
6,636,407 B1 * 10/2003 Ryman ..... H01P 1/202 361/113
6,721,155 B2 * 4/2004 Ryman ..... H01P 1/202 361/117
6,860,761 B2 * 3/2005 Lee ..... H01R 4/28 439/582
7,094,104 B1 * 8/2006 Burke ..... H01R 24/42 439/620.01
9,645,341 B2 * 5/2017 Islam ..... G02B 6/4416
2003/0203674 A1 * 10/2003 Baker ..... H01R 9/0515 439/582
2004/0169986 A1 9/2004 Kauffman
2005/0148225 A1 * 7/2005 Zahlit ..... H01R 24/46 439/188
2009/0278622 A1 11/2009 Phuyal et al.
2011/0201230 A1 * 8/2011 Islam ..... H01R 13/565 439/578
2013/0157506 A1 * 6/2013 Grek ..... H01R 9/0503 439/578
2014/0177122 A1 6/2014 Kauffman
2014/0322970 A1 * 10/2014 Binder ..... H01R 13/629 439/578
2015/0200469 A1 * 7/2015 Vaccaro ..... H01R 9/0503 439/578
2016/0226161 A1 * 8/2016 Zhang ..... H01R 9/0503
2016/0322751 A1 * 11/2016 Van Swearingen ..... H01R 13/642

* cited by examiner

COAXIAL BIAS T-CONNECTOR

RELATED APPLICATION

The present application claims priority from and the benefit of Chinese Patent Application No. 201810206740.9, filed Mar. 14, 2018, the disclosure of which is hereby incorporated herein by reference in its entirety.

FIELD OF THE INVENTION

The present invention is directed generally to electrical cable connectors, and more particularly to coaxial bias T-connectors.

BACKGROUND

Coaxial cables are commonly utilized in RF communications systems. A typical coaxial cable includes an inner conductor, an outer conductor, a dielectric layer that separates the inner and outer conductors, and a jacket that covers the outer conductor. Coaxial cable connectors may be applied to terminate coaxial cables, for example, in communication systems requiring a high level of precision and reliability.

Coaxial connector interfaces provide a connect/disconnect functionality between (a) a cable terminated with a connector bearing the desired connector interface and (b) a corresponding connector with a mating connector interface mounted on an electronic apparatus or on another cable. Typically, one connector will include a structure such as a pin or post connected to an inner conductor of the coaxial cable and an outer conductor connector body connected to the outer conductor of the coaxial cable; these connectors are mated with a mating sleeve (for the pin or post of the inner conductor) and another outer connector body of a second connector. Coaxial connector interfaces often utilize a threaded coupling nut or other retainer that draws the connector interface pair into secure electro-mechanical engagement when the coupling nut (which is captured by one of the connectors) is threaded onto the other connector.

A bias "T" is often used to insert DC power onto a cabling connection that also carries an AC signal. The DC power signal may be used to power remote antenna amplifiers or other devices. The bias "T" is usually positioned at the receiving end of the coaxial cable to pass DC power from an external source to the coaxial cable running to a powered device. A bias "T" may include a feed inductor to deliver DC power to a coaxial connector on the device side and a blocking capacitor to keep DC power from passing through to the receiver. The RF signal is connected directly from one connector to the other with only the blocking capacitor in series. An internal blocking diode prevents damage to the bias "T" if reverse supply voltage is applied. An exemplary coaxial bias t-connector is described in U.S. Pat. No. 7,094,104 to Burke et al., the disclosure of which is hereby incorporated herein in its entirety.

SUMMARY

As a first aspect, embodiments of the invention are directed to a coaxial bias T-connector, comprising: a first coaxial cable, comprising a first inner conductor and a first outer conductor electrically isolated from the first inner conductor; a second coaxial cable, comprising a second inner conductor and a second outer conductor electrically isolated from the second inner conductor; a rear body electrically connected to the first outer conductor; a first inner contact positioned within the rear body and electrically isolated therefrom, the first inner contact electrically connected with the first inner conductor; a front body connected with the rear body, the front body including a forward portion; a second inner contact positioned within the front body and electrically isolated therefrom, the second inner contact electrically connected with the first inner contact; a spring basket electrically connected with the forward portion of the front body and electrically isolated from the second inner contact, the spring basket including a plurality of spring fingers, the forward portion of the front body, the spring fingers and the second inner contact forming a 4.3/10 interface; a third inner contact electrically connected with the second inner conductor; and a coaxial fitting electrically connected with the front body and with the second outer conductor. The third inner contact is in electrical connection with the second inner contact. The resulting assembly is a coaxial bias T-connector that can meet the specifications of a 4.3/10 interface.

As a second aspect, embodiments of the invention are directed to a coaxial bias T-connector, comprising: a first coaxial cable, comprising a first inner conductor and a first outer conductor electrically isolated from the first inner conductor; a second coaxial cable, comprising a second inner conductor and a second outer conductor electrically isolated from the second inner conductor, wherein the second coaxial cable is smaller in diameter than the first coaxial cable; a rear body electrically connected to the first outer conductor; a first inner contact positioned within the rear body and electrically isolated therefrom, the first inner contact electrically connected with the first inner conductor; a front body connected with the rear body, the front body including a forward portion; a second inner contact positioned within the front body and electrically isolated therefrom, the second inner contact electrically connected with the first inner contact; a spring basket electrically connected with the forward portion of the front body and electrically isolated from the second inner contact, the spring basket including a plurality of spring fingers, the forward portion of the front body, the spring fingers and the second inner contact forming a 4.3/10 interface; a third inner contact electrically connected with the second inner conductor; and a right angle coaxial fitting electrically connected with the front body and with the second outer conductor. The third inner contact is in electrical connection with the second inner contact.

DETAILED DESCRIPTION

Figure 1:
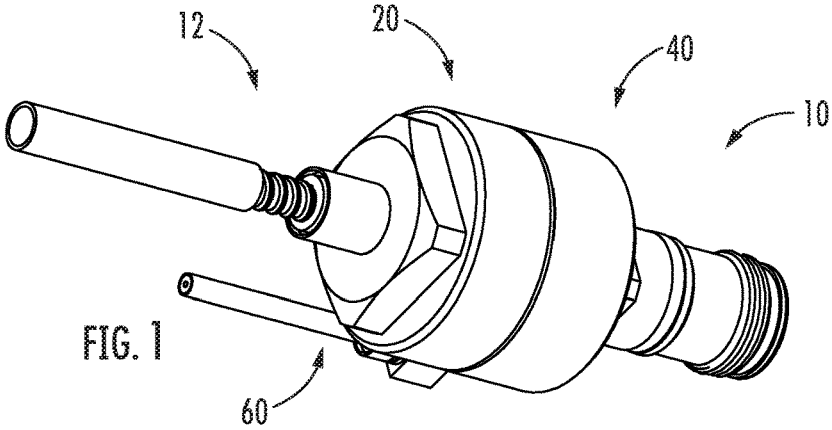
FIG. 1 is a front perspective view of a coaxial bias T-connector according to embodiments of the invention.
Figure 2:
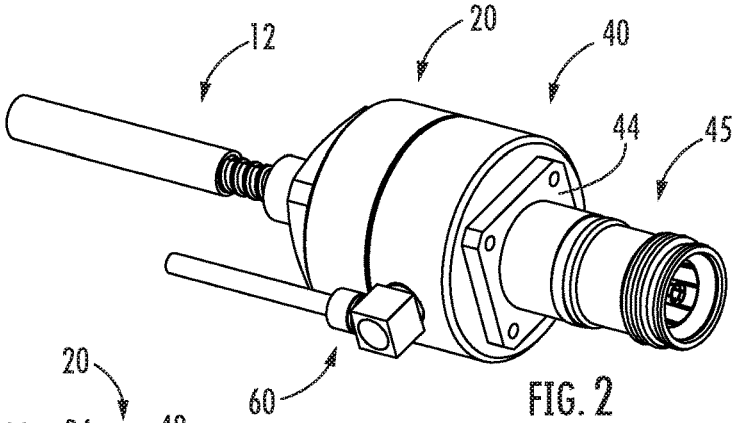
FIG. 2 is a rear perspective view of the coaxial bias T-connector of FIG. 1.
Figure 3:
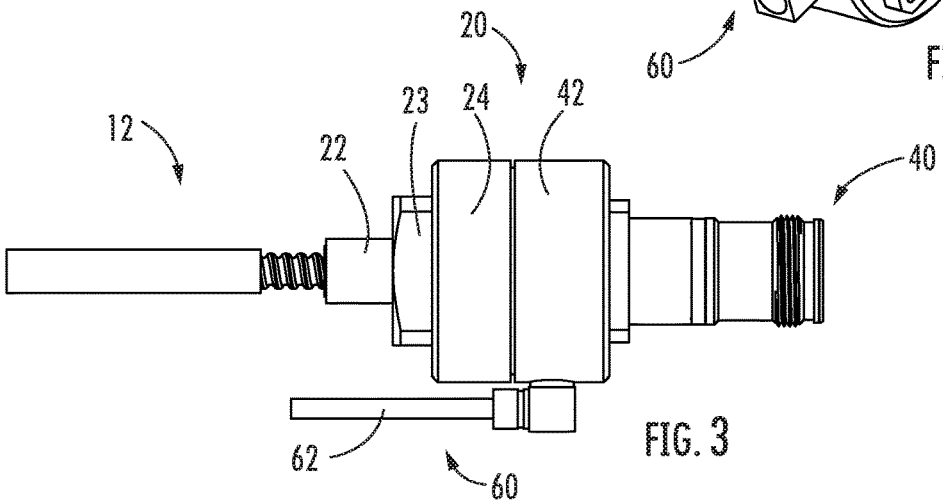
FIG. 3 is a side view of the coaxial bias T-connector of FIG. 1.
Figure 4:
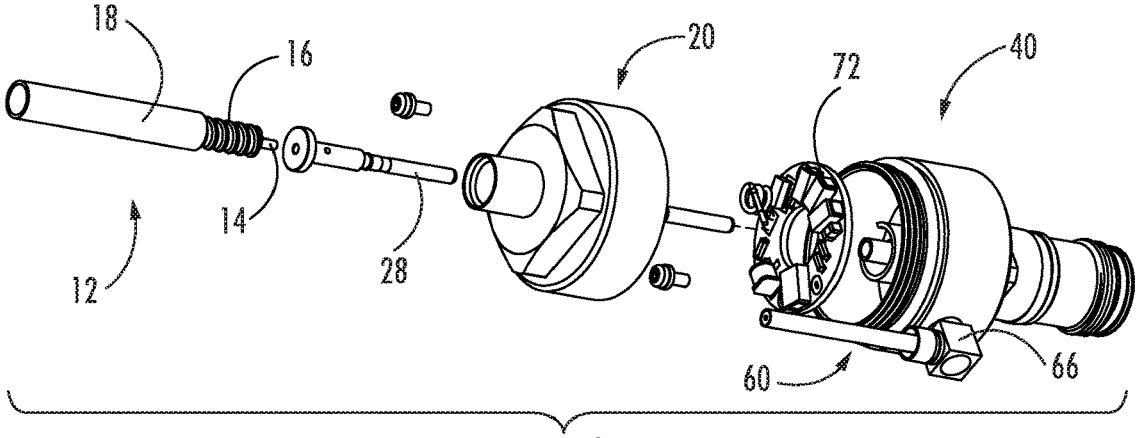
FIG. 4 is an exploded front perspective view of the coaxial bias T-connector of FIG. 1.
Figure 5:
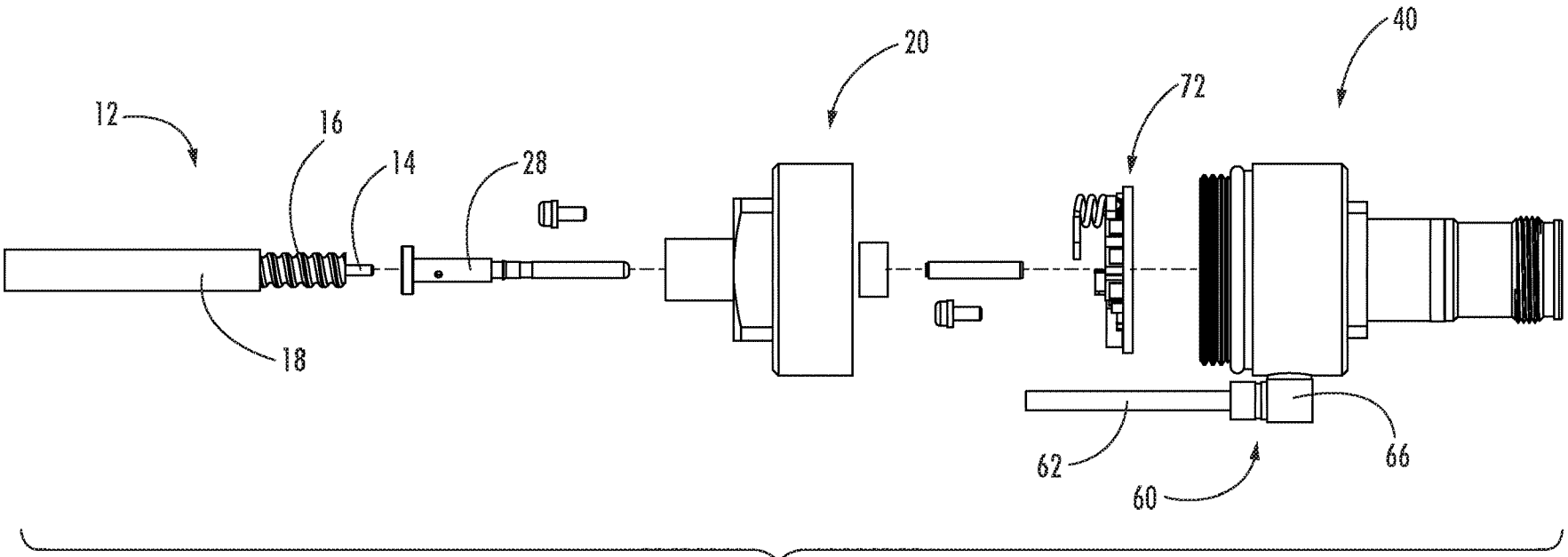
FIG. 5 is an exploded side view of the coaxial bias T-connector of FIG. 1.

The present invention now is described more fully hereinafter with reference to the accompanying drawings, in which embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art.

Like numbers refer to like elements throughout. In the figures, the thickness of certain lines, layers, components, elements or features may be exaggerated for clarity.

The terminology used herein is for the purpose of describing particular embodiments only and is not intended to be limiting of the invention. Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the specification and relevant art and should not be interpreted in an idealized or overly formal sense unless expressly so defined herein. Well-known functions or constructions may not be described in detail for brevity and/or clarity.

As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. As used herein, phrases such as "between X and Y" and "between about X and Y" should be interpreted to include X and Y. As used herein, phrases such as "between about X and Y" mean "between about X and about Y." As used herein, phrases such as "from about X to Y" mean "from about X to about Y."

It will be understood that when an element is referred to as being "on", "attached" to, "connected" to, "coupled" with, "contacting", etc., another element, it can be directly on, attached to, connected to, coupled with or contacting the other element or intervening elements may also be present. In contrast, when an element is referred to as being, for example, "directly on", "directly attached" to, "directly connected" to, "directly coupled" with or "directly contacting" another element, there are no intervening elements present. It will also be appreciated by those of skill in the art that references to a structure or feature that is disposed "adjacent" another feature may have portions that overlap or underlie the adjacent feature.

Spatially relative terms, such as "under", "below", "lower", "over", "upper", "lateral", "left", "right" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is inverted, elements described as "under" or "beneath" other elements or features would then be oriented "over" the other elements or features. The device may be otherwise oriented (rotated 90 degrees or at other orientations) and the descriptors of relative spatial relationships used herein interpreted accordingly.

Also, as used herein, the terms "horizontal" and "vertical" are intended to encompass structures that may vary from precise horizontal or vertical orientations by a small amount (e.g., 5-10 degrees).

Referring now to the drawings, a coaxial bias T-connector according to embodiments of the invention is shown in FIGS. 1-8 and designated broadly at 10. The connector 10 includes a coaxial cable 12, a rear body 20, a front body 40, and a biasing cable assembly 60. These components are described in great detail below.

Referring to FIGS. 1-7, the coaxial cable 12 may be of conventional construction and includes an inner conductor 14, a dielectric layer 15, an outer conductor 16 (which in this instance is corrugated, although smooth or braided outer conductors may also be employed), and a jacket 18. An inner contact 28 is attached to the forward end of the inner conductor 14. An exemplary cable 12 is the 50 ohm PTS1 coaxial cable, available from CommScope, Inc. (Hickory, N.C.).

Referring still to FIGS. 1-7, the rear body 20 is annular with a stepped profile. A narrow rear section 22 encircles the end of the outer conductor 16 of the cable 12 and is electrically connected thereto (typically via soldering, such as induction soldering). An intermediate section 23 has a generally square outer surface and an inner surface that is similar in diameter to the rear section 22. A wider forward section 24 has an outer diameter that is greater than widest dimension of the intermediate section 23, and has an inner diameter that is much greater than that of the rear and intermediate sections 22, 23. The forward section 24 has threads 25 on its inner diameter. A sleeve 29 is located radially inwardly of the forward section 24. A small insulator 26 is located at the forward end of the outer conductor 16 to position and isolate the inner conductor 14 and the inner contact 28 from the rear section 22 of the rear body 20. Also, a large insulator 27 is located partially within the sleeve 29 to position and isolate the sleeve 29 from the inner contact 28.

Referring again to FIGS. 1-7, like the rear body 20, the front body 40 is annular with a stepped profile. Its rear section 42 is similar in outer diameter to the forward section 24 of the rear body 20. The rear section 42 has threads 43 that intermesh with the threads 25 of the forward section 24. The front body 40 also has an intermediate section 44 that is similar to the intermediate section 23 of the rear body 20. The front body 40 also has a forward section 45 that extends forwardly from the intermediate section 44. The forward section 45 has a rear portion 46 and a forward portion 47 that is slightly smaller in outer diameter than the rear portion 46. The forward portion 47 includes threads 48 on its outer surface near its forward end.

Figure 6:
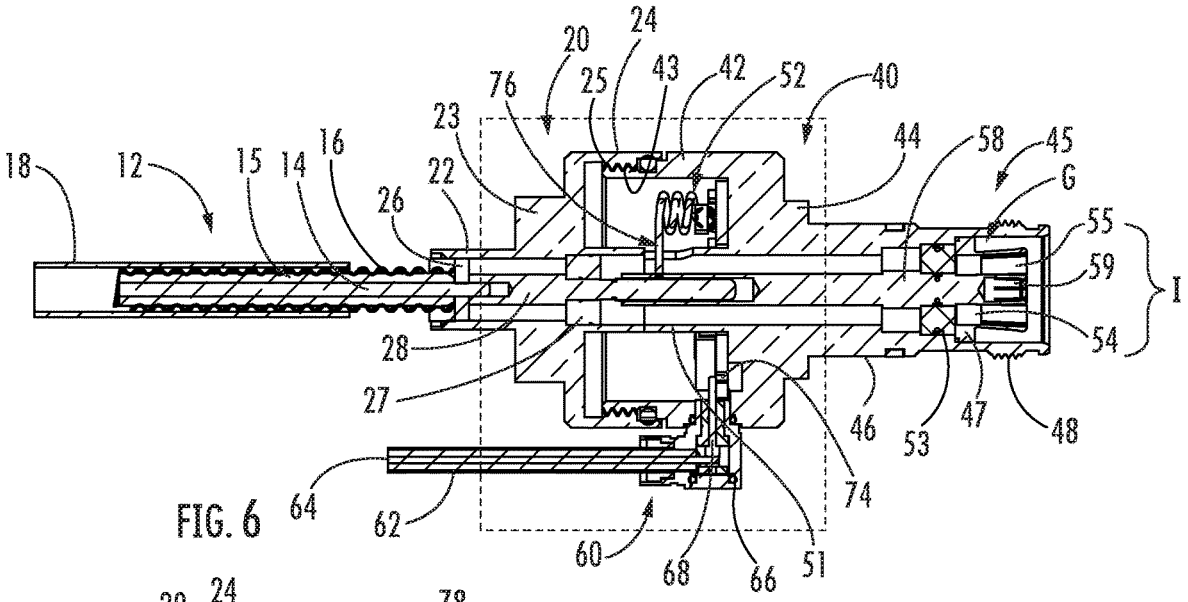
FIG. 6 is a side section view of the coaxial bias T-connector of FIG. 1.
Figure 7:
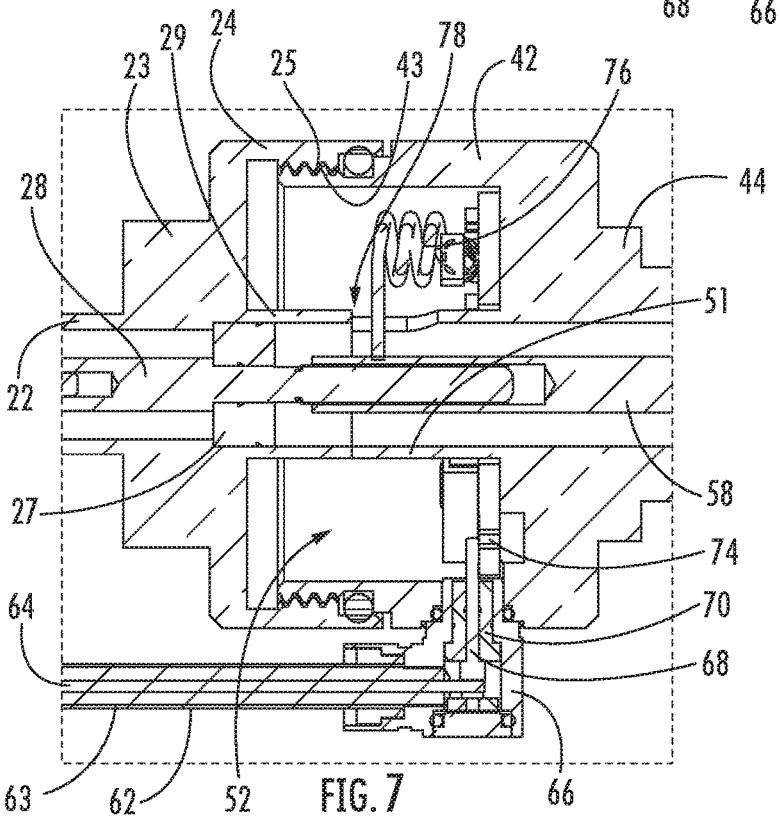
FIG. 7 is an enlarged partial side section view of the coaxial bias T-connector of FIG. 1.

As shown in FIGS. 6 and 7, the inner surface of the front body 40 also has a stepped profile. At its rearward end, the front body 40 has an inner diameter slightly less than that of the forward section 24 of the rear body 20, such that a cavity 52 is formed therein. The inner surface of the front body 40 is narrowest in its intermediate portion, and widens slightly in stepwise fashion at its forward end. A sleeve 51 extends rearwardly from the intermediate portion of the inner surface to abut the sleeve 29 of the rear body 20. An insulator 53 is positioned near the forward end. A spring basket 54 is positioned forwardly of the insulator 53, with the rear end of the spring basket 54 abutting a shoulder 56 in the inner surface of the front body 40. The fingers 55 of the spring basket 54 are positioned radially inwardly of the forward portion 47 of the forward section 45, such that a gap G is formed between the fingers 55 and the forward portion 47.

Referring still to FIGS. 6 and 7, an inner contact 58 is attached at its rear end to the inner contact 28 of the rear body 20 and extends forwardly therefrom. The inner contact 58 includes spring fingers 59 at its forward end. The inner contact 58 is held in position and in electrical isolation from the forward portion 47 by the insulator 53. Together, the inner contact 58, the spring basket 54 and the forward portion 47 define a connector interface I that meets the requirements set forth in the proposed 4.3/10 standard set forth in matter IEC (46F/243/NP) of the International Electrical Commission (an international standards body), and therefore form a female "4.3/10" connector. As such, the interface I can mate with a standard 4.3/10 male connector.

Figure 8:
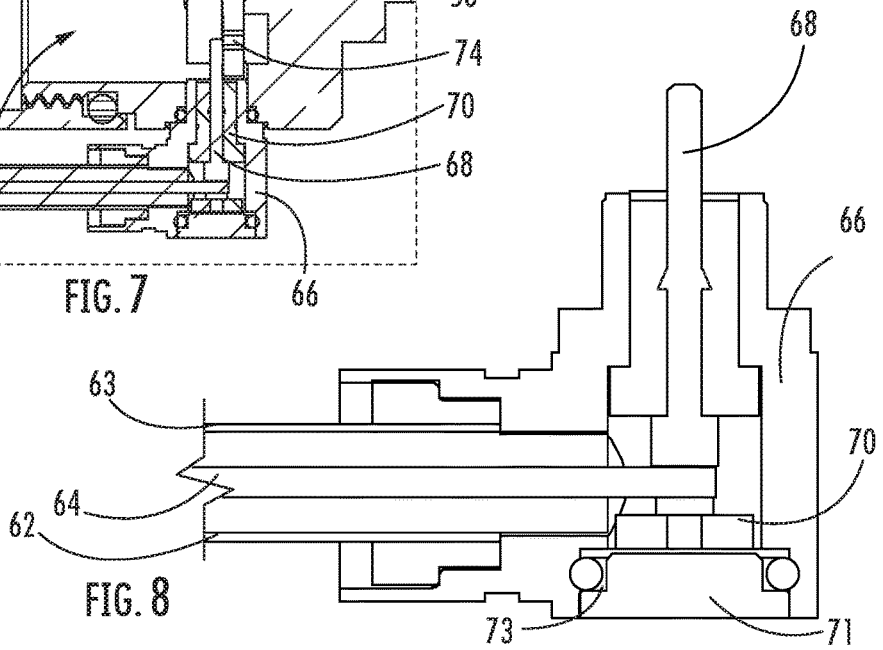
FIG. 8 is an enlarged side section view of the biasing cable assembly of the bias T-connector of FIG. 1.

Referring to FIGS. 6-8, the biasing cable assembly 60 includes a cable 62 with an inner conductor 64 and an outer conductor 63. An exemplary cable is the C141 cable, available from CommScope, Inc. A right angle fitting 66 is mounted to the rear section 43 of the front body 40 and receives the cable 62 as it is routed forwardly, with the outer conductor 63 of the cable 62 making an electrical connection with the fitting 66. A contact 68 within the fitting 66 receives and is electrically connected to the conductor 64. The contact 68 passes through an insulator 70 and into the cavity 52 of the front body 40. A cap 71 plugs a hole 73 in the fitting 66; the hole 73 provides access to the interior of the fitting 66 for assembly.

Referring to FIGS. 4 and 6-8, an annular printed circuit board (PCB) 72 encircles the sleeve 51. Multiple components are mounted on the PCB 72, including a contact pad 74 and an inductor 76. The inductor 76 extends through a hole 78 in the sleeve 51 to contact the inner contact 58 of the front body 40. The contact 68 is connected with the contact pad 74 on the PCB 72. Thus, the cable 62 is electrically connected with the inner contact 58 and with the front and rear bodies 20, 40 and is thus capable of injecting direct current to the inner contact 58 (and the components, like the inner contact 28, to which it is electrically connected) in the manner of a typical bias T-connector. Such a signal may be employed, for example, to control the tilt of a wireless communications antenna.

The coaxial bias T-connector 10 described herein may have performance advantages over prior devices. Because the connector 10 has an interface I that can mate with a 4.3/10 male connector, no additional connectors or adapters are required to make such a connection. Also, the integration of the biasing cable 62 into the connector 10 eliminates an additional connection. Both of these advantages can save cost on connectors and adapters, which can reduce the overall cost of the assembly. In addition, the coaxial bias T-connector 10 may have low passive intermodulation (PIM); in particular, the interconnections between the various components may be made via soldering (particularly inductive soldering), which can provide desirable PIM and return loss performance. Moreover, the connector 10 can provide good isolation between the various ports for RF and AISG2.0 and AISG3.0 signals. Good PIM, return loss and isolation between ports is also possible for AISG 2 Mhz signals.

Those of skill in this art will appreciate that the coaxial T-bias connector 10 may take other forms. For example, either or both of the rear and front bodies 20, 40 may have different configurations, and/or may be interconnected via means other than threads, such as latches, detents or the like. The inductor 76 of the PCB 72 may directly contact the inner contact 28 (rather than directly contacting the inner contact 51) to establish electrical connection with the inner contacts 28, 51 and the inner conductor 14. A device other than an inductor may be employed on the PCB 72. Other variations may also be employed.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

That which is claimed is:

1. A coaxial bias T-connector, comprising:

a first coaxial cable, comprising a first inner conductor and a first outer conductor electrically isolated from the first inner conductor;

a second coaxial cable, comprising a second inner conductor and a second outer conductor electrically isolated from the second inner conductor;

a rear body electrically connected to the first outer conductor;

a first inner contact positioned within the rear body and electrically isolated therefrom, the first inner contact electrically connected with the first inner conductor;

a front body connected with the rear body, the front body including a forward portion;

a second inner contact positioned within the front body and electrically isolated therefrom, the second inner contact electrically connected with the first inner contact;

a spring basket electrically connected with the forward portion of the front body and electrically isolated from the second inner contact, the spring basket including a plurality of spring fingers, the forward portion of the front body, the spring fingers and the second inner contact forming a 4.3/10 interface;

a third inner contact electrically connected with the second inner conductor; and a coaxial fitting electrically connected with the front body and with the second outer conductor and mounted directly to the front body;

wherein the third inner contact extends outside of the fitting and from within the fitting and is in electrical connection with the second inner contact.

2. The bias T-connector defined in claim 1, further comprising a printed circuit board positioned within the front body, the third inner contact being electrically connected to the second inner contact through the printed circuit board.

3. The bias T-connector defined in claim 2, wherein the printed circuit board includes an inductor in contact with the second inner contact.

4. The bias T-connector defined in claim 3, wherein the rear body includes a first sleeve, the front body includes a second sleeve that abuts the first sleeve, and the inductor is routed from the printed circuit board to the second inner contact through a hole in the second sleeve.

5. The bias T-connector defined in claim 1, wherein the coaxial fitting is a right angle coaxial fitting.

6. The bias T-connector defined in claim 1, wherein the front body includes threads that intermesh with threads on the rear body.

7. The bias T-connector defined in claim 1, wherein the forward portion of the front body, the spring basket, and the second inner contact are configured to define a female 4.3/10 connector interface.

8. The bias T-connector defined in claim 1, wherein the second coaxial cable is smaller in diameter than the first coaxial cable.

9. The bias T-connector defined in claim 8, wherein the first coaxial cable is a nominally rated 50 ohm coaxial cable.

10. A coaxial bias T-connector, comprising:

a first coaxial cable, comprising a first inner conductor and a first outer conductor electrically isolated from the first inner conductor;

a second coaxial cable, comprising a second inner conductor and a second outer conductor electrically isolated from the second inner conductor, wherein the second coaxial cable is smaller in diameter than the first coaxial cable;

a rear body electrically connected to the first outer conductor;

a first inner contact positioned within the rear body and electrically isolated therefrom, the first inner contact electrically connected with the first inner conductor;

a front body connected with the rear body, the front body including a forward portion;

a second inner contact positioned within the front body and electrically isolated therefrom, the second inner contact electrically connected with the first inner contact;

a spring basket electrically connected with the forward portion of the front body and electrically isolated from the second inner contact, the spring basket including a plurality of spring fingers, the forward portion of the front body, the spring fingers and the second inner contact forming a 4.3/10 interface;

a third inner contact electrically connected with the second inner conductor; and a right angle coaxial fitting electrically connected with the front body and with the second outer conductor and mounted directly to the front body;

wherein the third inner contact extends outside of the fitting and from within the fitting and is in electrical connection with the second inner contact.

11. The bias T-connector defined in claim 10, further comprising a printed circuit board positioned within the front body, the third inner contact being electrically connected to the second inner contact through the printed circuit board.

12. The bias T-connector defined in claim 11, wherein the printed circuit board includes an inductor in contact with the second inner contact.

13. The bias T-connector defined in claim 12, wherein the rear body includes a first sleeve, the front body includes a second sleeve that abuts the first sleeve, and the inductor is routed from the printed circuit board to the second inner contact through a hole in the second sleeve.

14. The bias T-connector defined in claim 13, wherein the first coaxial cable is a nominally rated 50 ohm coaxial cable.

15. The bias T-connector defined in claim 10, wherein the front body includes threads that intermesh with threads on the rear body.

16. The bias T-connector defined in claim 10, wherein the forward portion of the front body, the spring basket, and the second inner contact are configured to define a female 4.3/10 connector interface.

* * * * *